US006585119B2

(12) United States Patent
Palder

(10) Patent No.: US 6,585,119 B2
(45) Date of Patent: Jul. 1, 2003

(54) MODULAR STORAGE SYSTEM FOR MULTIPLE STACKS

(76) Inventor: Saul Palder, 1476 River St., Hyde Park, MA (US) 02136

( * ) Notice: Subject to any disclaimer, the term of this patent is extended or adjusted under 35 U.S.C. 154(b) by 0 days.

(21) Appl. No.: 09/938,919

(22) Filed: Aug. 24, 2001

(65) Prior Publication Data

US 2003/0038097 A1 Feb. 27, 2003

(51) Int. Cl.[7] ..... A47F 5/00

(52) U.S. Cl. ..... 211/49.1; 211/163; 211/78; 312/133; 312/322

(58) Field of Search ..... 211/77, 78, 163, 211/49.1, 41.2, 194, 95; 248/416; 312/133, 238, 322

(56) References Cited

U.S. PATENT DOCUMENTS

| | | | | | |
|---|---|---|---|---|---|
| 617,478 | A | * | 1/1899 | Cohen | |
| 1,690,394 | A | * | 11/1928 | Belt | |
| 1,759,140 | A | * | 5/1930 | Silberger | |
| 2,070,055 | A | * | 2/1937 | Levien | |
| 2,121,711 | A | * | 6/1938 | Patts | 211/77 |
| 2,622,956 | A | * | 12/1952 | White | |
| 3,107,959 | A | * | 10/1963 | Maxwell | |
| 3,467,455 | A | * | 9/1969 | Caldemeyer | |
| 3,982,800 | A | | 9/1976 | Gorton | |
| 4,143,765 | A | * | 3/1979 | Moss | 211/78 X |
| 4,181,037 | A | | 1/1980 | Boon et al. | |
| 4,433,885 | A | | 2/1984 | Baker | |
| 4,775,055 | A | | 10/1988 | Morse | |
| 5,024,168 | A | | 6/1991 | Stravitz | |
| 5,033,626 | A | * | 7/1991 | Platti | 211/163 X |
| 5,207,335 | A | | 5/1993 | Voelz | |
| 5,299,695 | A | | 4/1994 | Taylor, Jr. | |
| 5,547,085 | A | | 8/1996 | Gaus | |
| 5,577,823 | A | | 11/1996 | Maglinger | |
| 6,017,108 | A | | 1/2000 | Domenig | |
| 6,149,019 | A | * | 11/2000 | Newman | 211/40 |

OTHER PUBLICATIONS

US 5,357,851, 10/1994, Bowman (withdrawn)
Kitchen Accessories Unlimited Website Printout Dated Feb. 5, 2001.

* cited by examiner

*Primary Examiner*—Robert W. Gibson, Jr.
(74) *Attorney, Agent, or Firm*—Wolf, Greenfield & Sacks, P.C.

(57) ABSTRACT

A storage system for stacks of like articles consisting of a fixed base positioned within a storage area and carrousel like stackholder assembly between a position vertically aligned with the base and at least partially external of the storage system. The stackholder assembly is formed with a plurality of radially arranged wells which may be dimensioned to receive different sized and/or shaped articles.

15 Claims, 7 Drawing Sheets

MODULAR STORAGE SYSTEM FOR MULTIPLE STACKS

FIELD OF THE INVENTION

The present invention relates to a storage system for multiple stacks of articles such as containers and in particular to a storage system adapted to stack a plurality of different sized articles in a plurality of stacks.

BACKGROUND OF THE INVENTION

Handling and storing stacks of like articles, such as containers or dishes or bowls involves a number of problems which have been handled in a variety of ways. For example, in restaurants, food "take-out" containers as well as washed dishes are frequently placed in stacks on shelves for subsequent use. Frequently these shelves are open and the stacks themselves are not protected. Consequently, there is not only a potential for damage to these stacks from a variety of causes, but also the stacks may more readily become soiled or contaminated. In other instances, open storage of stacked dishes and like articles involves undesirable esthetic effects.

Frequently, trays and fixed bins for receiving stacks of articles such as dishes are used, but are not altogether satisfactory for a variety of reasons.

SUMMARY OF THE INVENTION

The present invention is directed to a system for storing and stacking like articles. In one embodiment the present invention provides an alternative system for storing and stacking articles in restaurants and in homes in a manner by which stacks of articles such as containers are safeguarded against inadvertent damage, and stored in a manner that will minimize inadvertent soiling and improve quick availability using a minimal space.

In the present invention, a storage system is provided for multiple stacks of like articles. In one embodiment of the invention, a base is shaped and sized to fit within a storage cabinet or counter. A rotatable modular stackholder is secured to the base by means that permits the stackholder to move to and from a position within the storage cabinet and remain in vertical alignment with the base. The modular array of stackholders may be rotated at any position within or outside the cabinet or counter. In this embodiment, the modular stackholder comprises multiple units that have mating surfaces adapted to interengage one another. Any number of these units may be stacked, depending upon the space in which the stackholder is positioned. Each of the stackholder units are similarly shaped with a plurality of different sized compartments to receive stacks of articles, such as containers and dishes.

These and other objects and advantages of the present invention will be more clearly understood when considered in conjunction with the accompanying drawings.

DETAILED DESCRIPTION

The storage system of the present invention is intended primarily for use in storing containers, dishes and similar items. However, it may be used to store other stackable or non-stackable articles for household, business or food purposes. In one preferred form illustrated in the present invention, the system is designed for use in a restaurant, home kitchen cabinet, or counter. It may, however, be used in other storage facilities as well. The unit itself consists primarily of a base 10, assembly 20, and means 30 (FIG. 5) for interengaging the base 10 and stackholder assembly or support 20 for movement of the stackholder assembly 20 to and from a position in vertical alignment with the base 10. The storage system may be made of any suitable material, such as wood, plastic or metal. It may also be formed of mesh material or a series of appropriately oriented bars or slats. However, for mass-produced, relatively inexpensive units, injection molded plastic is a preferred form of material.

Base 10 may be varied in shape and size, but preferably is cylindrical in shape. Alternately, the base, as well the stackholder, may have other shapes such as square or rectangular, depending upon the particular shape and size of the space in which they are to be located. When used in a kitchen or restaurant to store containers such as dishes, the unit may be cylindrical in shape with an overall diameter in the order of 10 inches to 2 feet. The overall height is determined by the cabinet or counter or shelf height in which the unit is positioned.

Figure 1:
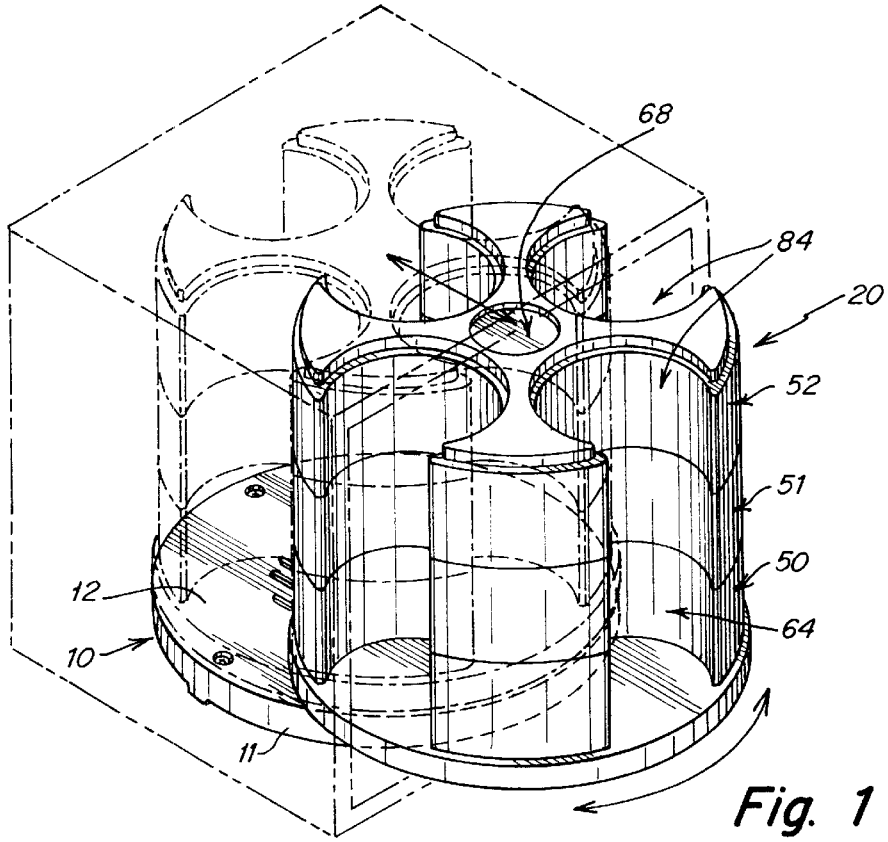
FIG. 1 is a perspective view of a storage unit in an extended open position showing an embodiment of the invention.
Figure 2:
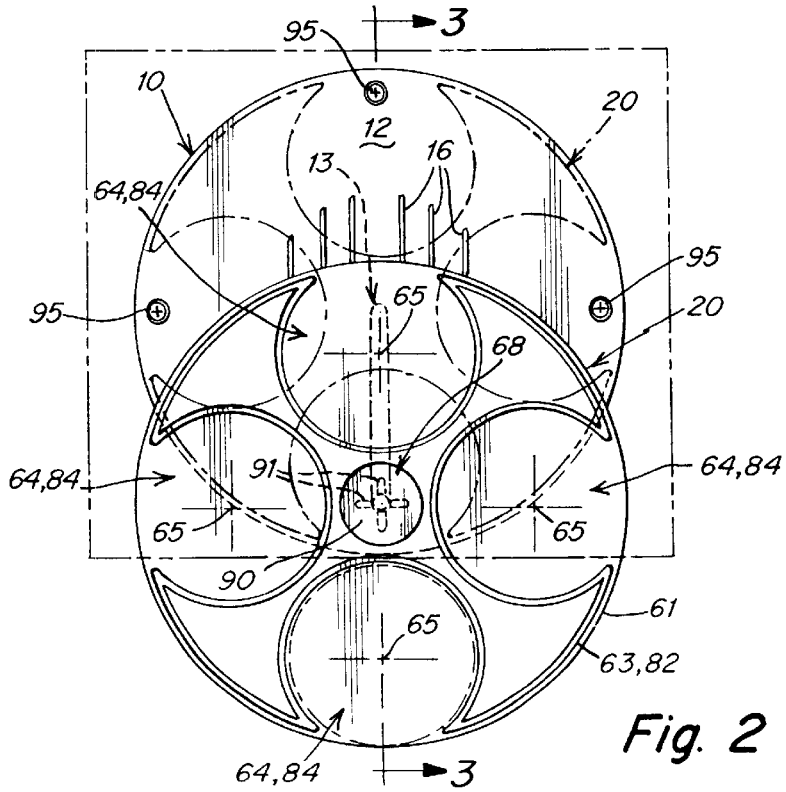
FIG. 2 is a top plan view of the embodiment of FIG. 1 also in an extended position.

In the embodiment illustrated in FIG. 1, the base 10 has a continuous sidewall 11 depending from a top 12. The sidewall 11 may be formed with finger room for grabbing this base and pulling it outward. The sidewall or skirt 11 may have any desired height and may be further provided with means for locking or securing the base to a shelf. Securing means might comprise tabs with screw holes extending from the base or alternately screws extending downwardly through the base 10 into the supporting shelf or cabinet base. Pads of velcro can be used to hold the unit in place.

The top 12 is formed with an elongated slot 13 that extends radially from the center of the top to a distance short of the skirt 11. This slot 13 may be defined by a depending circumferential flange 14 (FIG. 4) that extends from its edge downwardly within the base 10. The base 10 may also be provided with a pair or more of parallel re-enforcing ribs 15 that extend traversely from the lower or under surface of top 12 across the base. These terminate short of flange 14 so as not to interfere with the slot 13. The upper surface of the top 12 may also be formed with a plurality of guide rails 16 that project upwardly from the surface of the top 12 in spaced relation to one another and parallel to slot 13.

Figure 4:
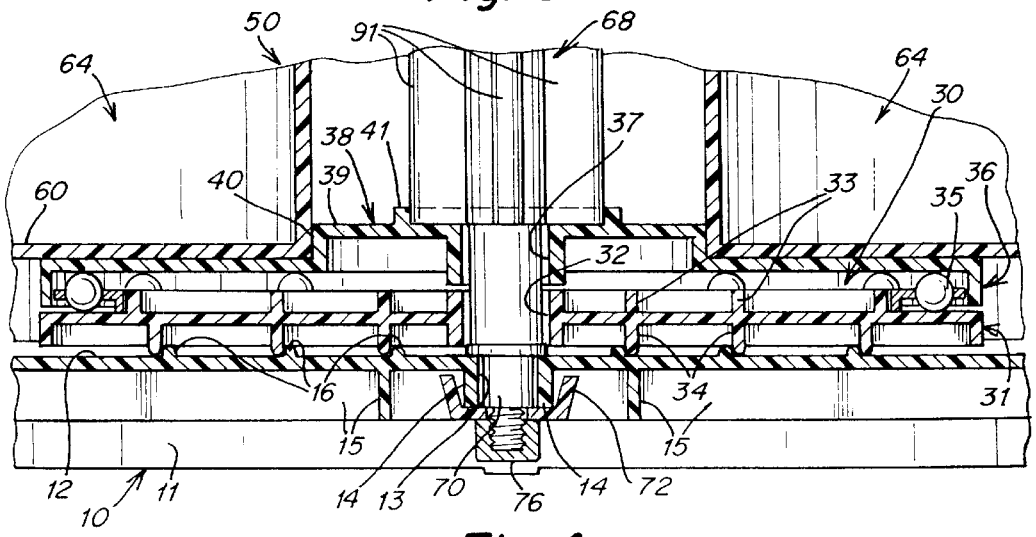
FIG. 4 is a fragmentary cross sectional view taken on the line 4—4 of FIG. 3.
Figure 5:
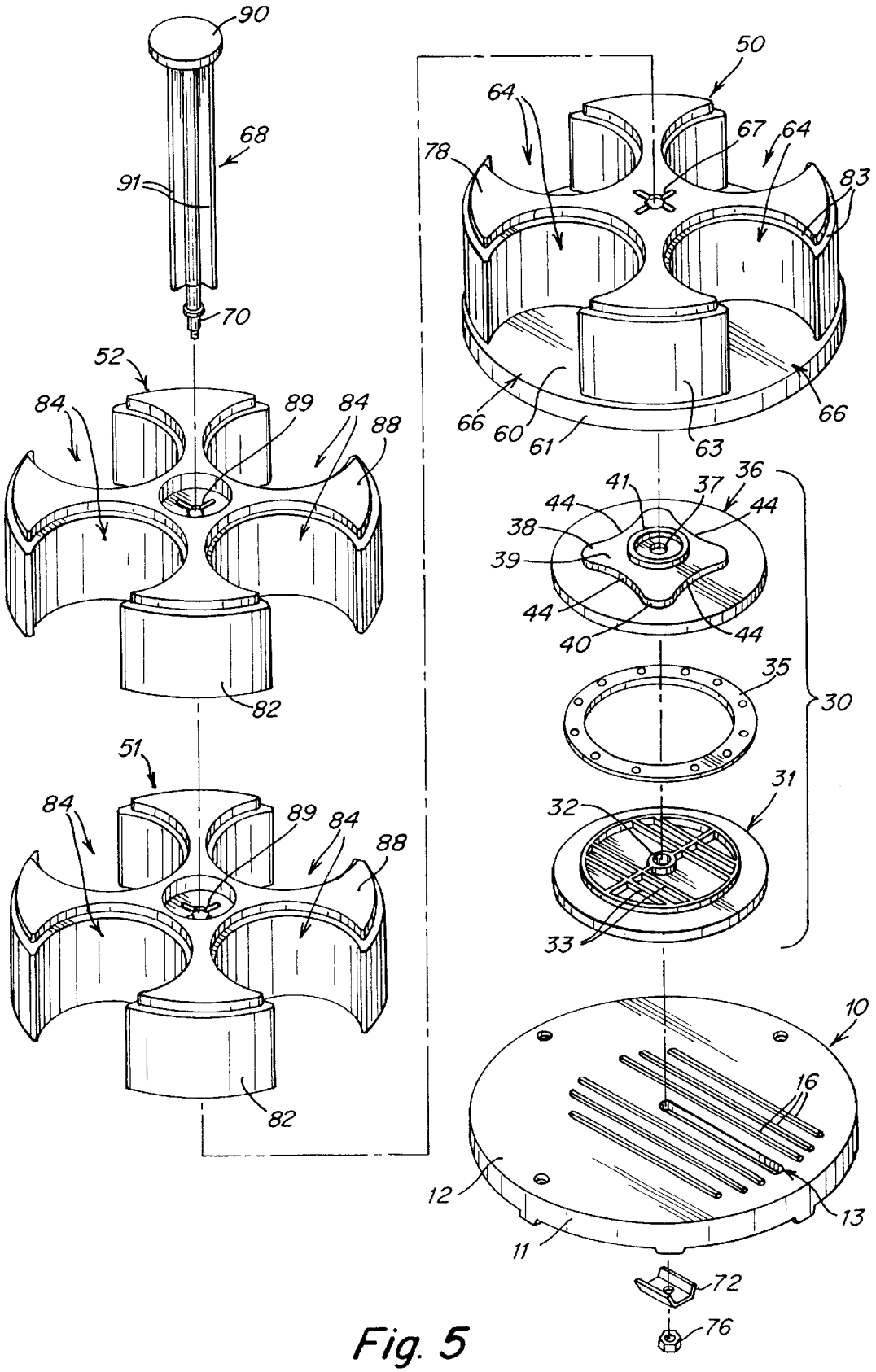
FIG. 5 is an exploded perspective view.

The means 30 for inter-engaging the base 10 and stackholder assembly 20 includes a bearing load base 31 which is coaxially mounted on the top 12 (see FIG. 5). The bearing load base 31 is formed with an opening 32 coaxial with and having the same diameter as the width of the slot 13 in the top 12 (FIG. 4). The bearing load base 31 is also formed with a plurality of upwardly extending ribs 33 and downwardly extending ribs 34. The downwardly extending ribs 34 are spaced apart and parallel to one another, with the ribs 34 engaging and guided by the rails 16 formed in the top 12. A ball bearing race 35 of conventional design is positioned on the top surface of the bearing load base 31 at its outer periphery. The bearing top cap 36 is coaxially aligned with the bearing load base 31. An opening 37 in the bearing top cap 36 is coaxial aligned with the opening 32 in the bearing load base and slot 13 in the base 10. The bearing top cap is formed with an upwardly displaced dome 38 having a top surface 39 and depending sidewalls 40. There is also provided an annular flange 41 that extends upwardly from the top surface 39 and radially spaced from opening 37. The depending sidewalls 40 are arcuately contoured as illustrated at 44 (FIG. 5) to receive portions of the stackholder assembly 20 as hereafter described.

The modular stackholder assembly 20, in a preferred embodiment, consists of a multiple number of individual, stackable units. These individual units, include in this preferred embodiment, a base stackholder 50, an intermediate stackholder 51, and a top stackholder 52 respectively aligned one on top of the other. While the preferred embodiment illustrated shows three stackholder units, fewer or greater numbers are also contemplated. The overall shape may also be varied from the cylindrical shape illustrated.

Figure 3:
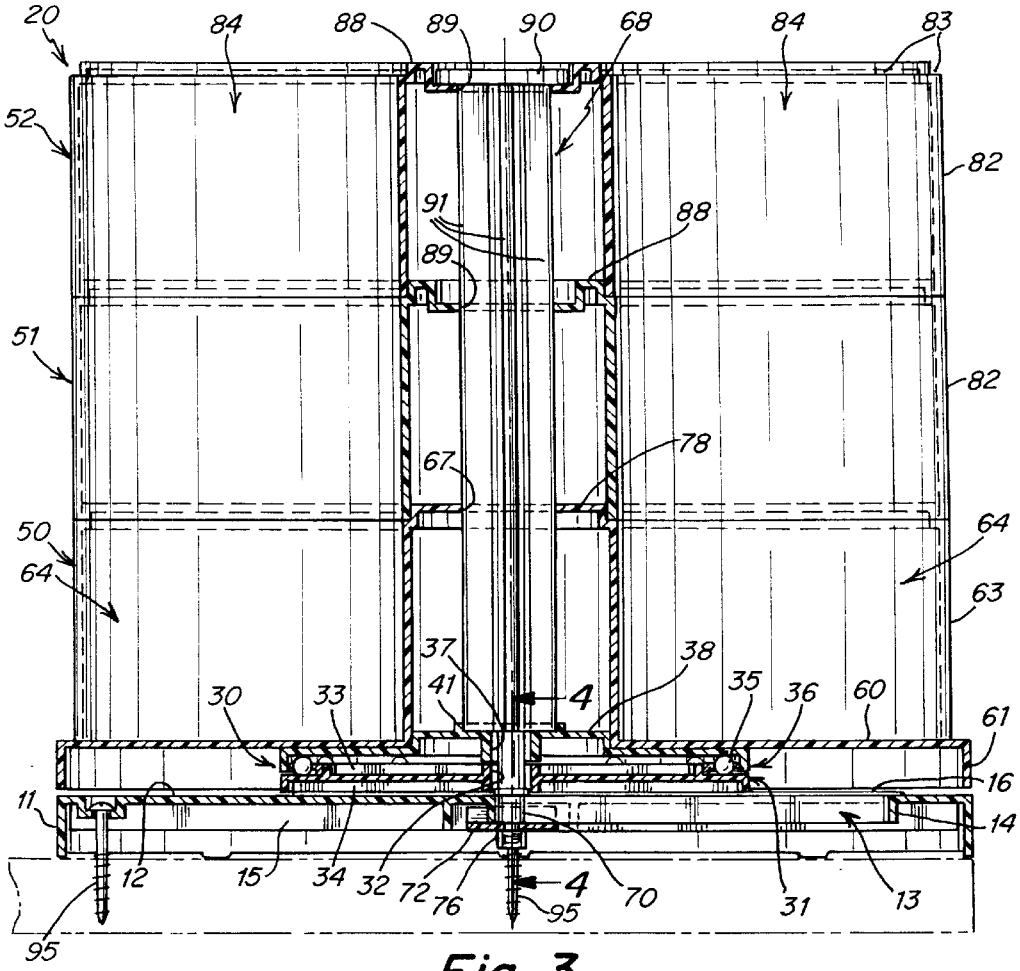
FIG. 3 is a cross sectional side view taken along the line 3—3 of FIG. 2.

The base stackholder 50 is formed with a bottom wall 60 that has an outer diameter coextensive with the outer diameter of the base 10. It is also provided with a downwardly extending continuous skirt 61 that is aligned with the skirt 11 of the base 10. The skirt 61 extends downwardly into close proximity to, but is spaced from the upper end of skirt 11 (FIG. 3). A wall 63 extends upwardly from the outer periphery of the bottom wall 60 except at a plurality of locations in which the wall 63 extends inwardly to form a plurality of cylindrical wells 64. In this preferred embodiment, four such cylindrical wells 64 are defined. However, fewer or more are also contemplated. In the embodiment illustrated, the wells are all of substantially equal dimension, but the invention also contemplates wells of varying dimensions. These wells 64 are intended to receive stacks of dishes, cups, or the like and for that reason, the specific shape and size of the well may be varied for the particular purpose for which the unit is intended.

In this embodiment, each essentially cylindrical well 64 is defined by arcuate wall 63 which are uniformly spaced from centers 65 with the radius of these wells less than half the distance between adjacent centers, thereby providing spacing between adjacent wells. The centers 64 are positioned close enough to the skirt 61 to form a relatively wide opening 66 which is less than the diameter of the well 65 in the side of the well adjacent to the skirt, thus providing easy hand access to a stack of items positioned within each well, while, at the same time, providing means for securing the stack of items within the wells.

A cross-shaped opening 67 is centrally formed in the cap 78 of the base stackholder 50. This cross-shaped opening is shaped to receive a center column connector 68 which extends downwardly through the top stackholder 52, intermediate stackholder 51, and base stackholder 50 into the base 10 through the openings 37, 32, and 13. The connector 68 has a cap 90 and four orthogonally related flanges that are shaped and sized to slide through the cross shaped openings 67, 89 to rotationally engage the stackholders 52, 51 and 50 and rotationally lock them together. The lower end 70 of the connector 68 engages a slide plate 72 that extends lengthwise of the slot 13. The bottom 70 of the connector 68 is secured by a cap nut 76 that locks the connector 68 to the slide plate 72 for sliding movement with the slide plate 72 slidingly engaging the flanges 14. A cap 78 extends across the upper edge of wall 63 with the cross shaped opening 67 formed therein. The outer edges of the cap 78 are formed with a shoulder 83 that forms an engaging element for the intermediate stack 51.

The intermediate stackholder 51 and top stackholder 52 may be similar in overall design. Each is formed with a sidewall 82 having an outer periphery at a radial distance equal to the radius of the base stackholder 50. The lower edge of wall 82 is shaped and sized to fit into and be engaged by shoulder 83. These stackholders 51 and 52 thus define a series of openings 84 that are aligned and co-extensive with and in part form the wells 64.

A cap 88 extends across wall 82 with a shoulder formed at the junction of the edges of cap 88 and sidewall 82. This shoulder is sized and shaped to engage the lower edge of a like unit for stacking purposes. The center of cap 88 is formed with a depression shaped and sized to receive cap 90 of the connector 68. The slot 89 is shaped to receive flanges 91 is formed through this depression.

The intermediate stackholder 51 may be replicated with more than one of such stackholders 51 included between the top stackholder 52 and base stackholder 50 to increase the height of the combination.

In the arrangement illustrated, the Lazy Susan-like unit having, in its fully assembled configuration three stackable units, may be stored in a position in which each of the parallel stackable units are directly over the base. Alternately, the stackable units may be moved laterally from the base by sliding the stackable units outwardly for more easy access to the items stored within the wells. Additionally, the Lazy Susan configuration permits the stackable units to be rotated at any time for ease in replacing or removing items such as dishes within the wells about an axis parallel to the stacks and to the lateral movement.

When stored in a cabinet such as a kitchen or restaurant cabinet the base of the unit may be fixed to the bottom of the cabinet by adhesive foam pads, velcro or small screws 95 and other suitable securing means. If preferred, such small screws extend through a mounting flange into the cabinet shelf. Thus the base is fixed within the cabinet but the upper portions may be slid outwardly and rotated for easy access to anyone of the multiple wells with the articles stacked on them. The wide openings formed by the sidewalls allow easy access to the stacked articles from the side of the stack. The arrangement also allows for sample inventory of the number of stacked articles in each well.

Figure 6:
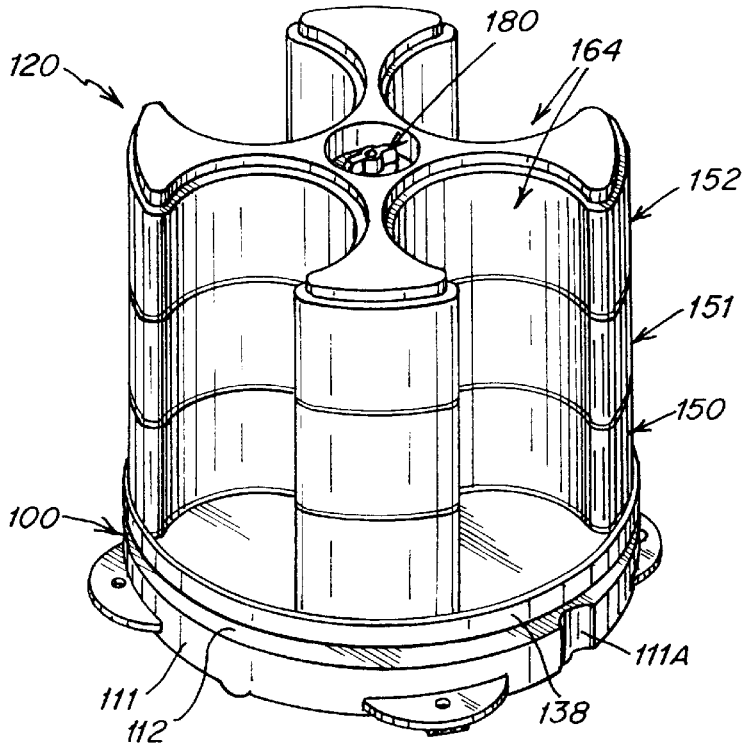
FIG. 6 is a perspective view of a preferred embodiment of a storage unit in a closed position.
Figure 7:
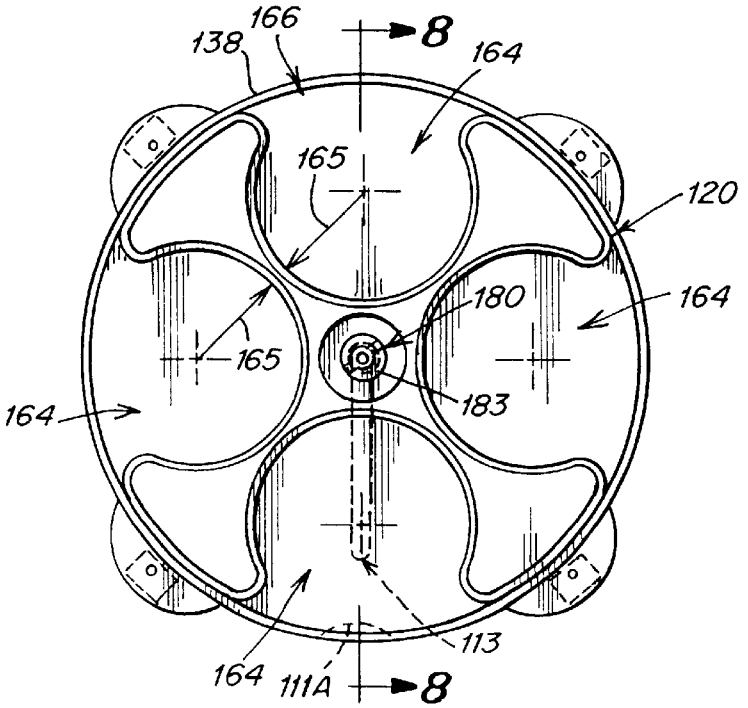
FIG. 7 is a top plan view of the embodiment of FIG. 6.
Figure 8:
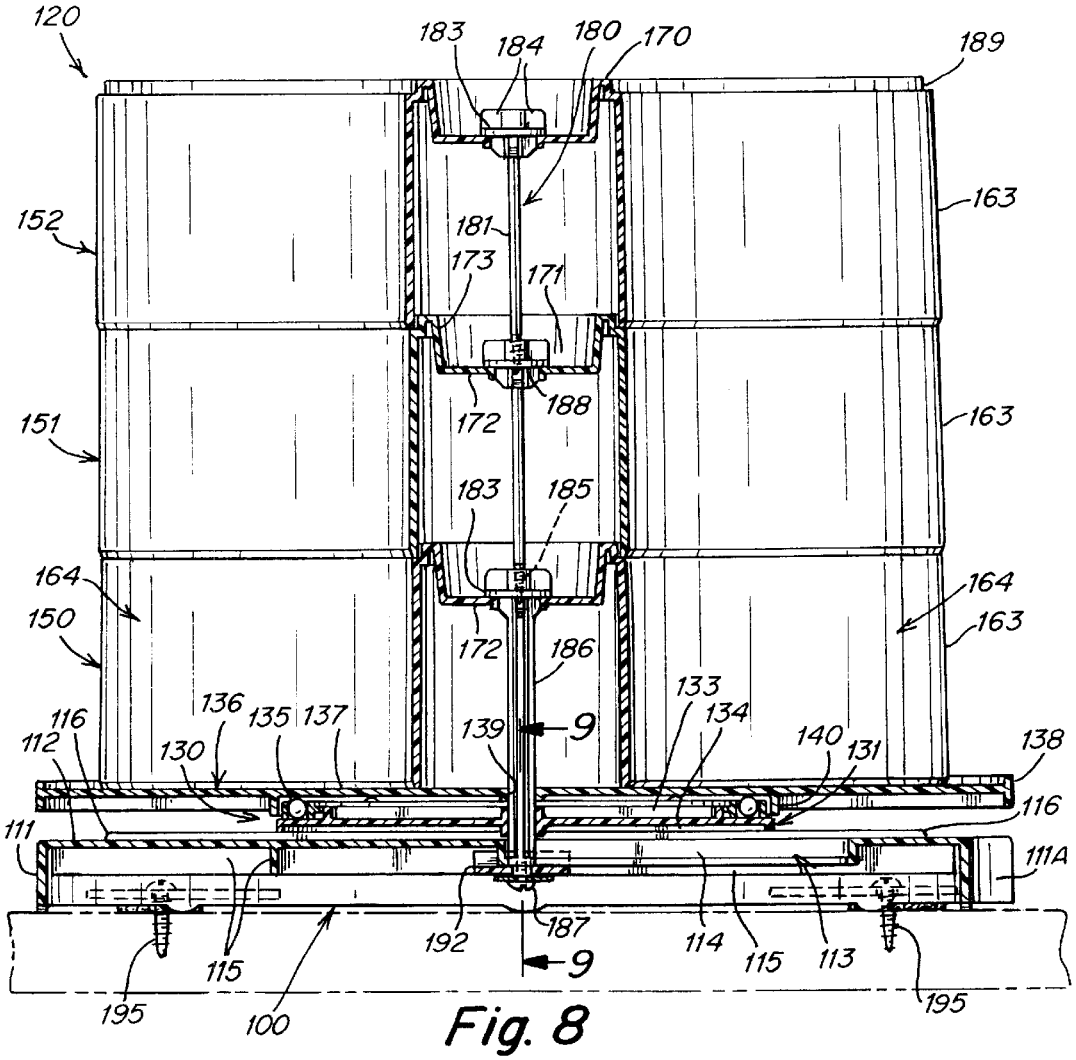
FIG. 8 is a view taken along the line 8—8 of FIG. 7.
Figure 9:
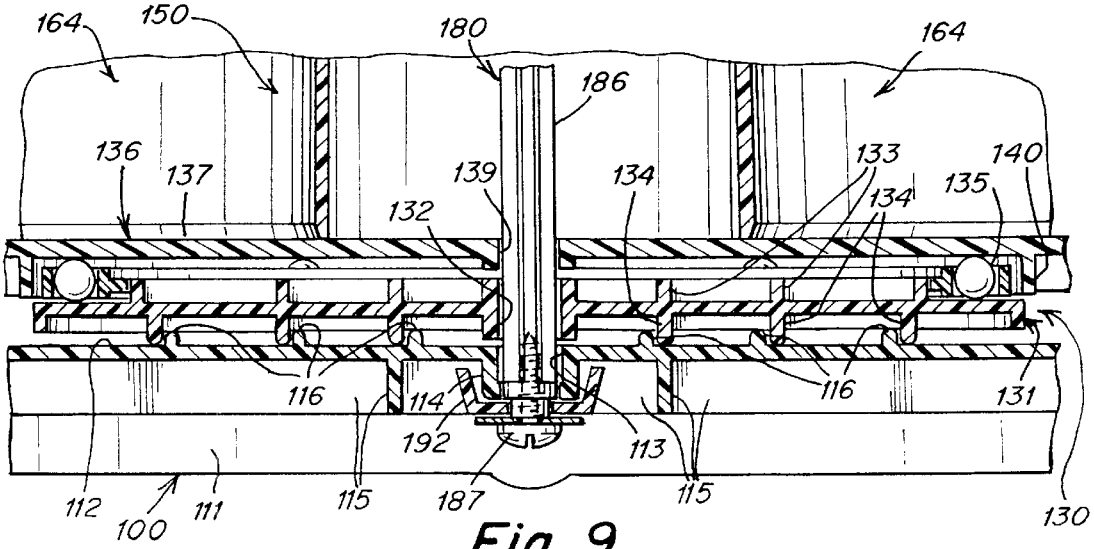
FIG. 9 is a fragmentary cross sectional side view of the embodiment of FIG. 6.
Figure 10:
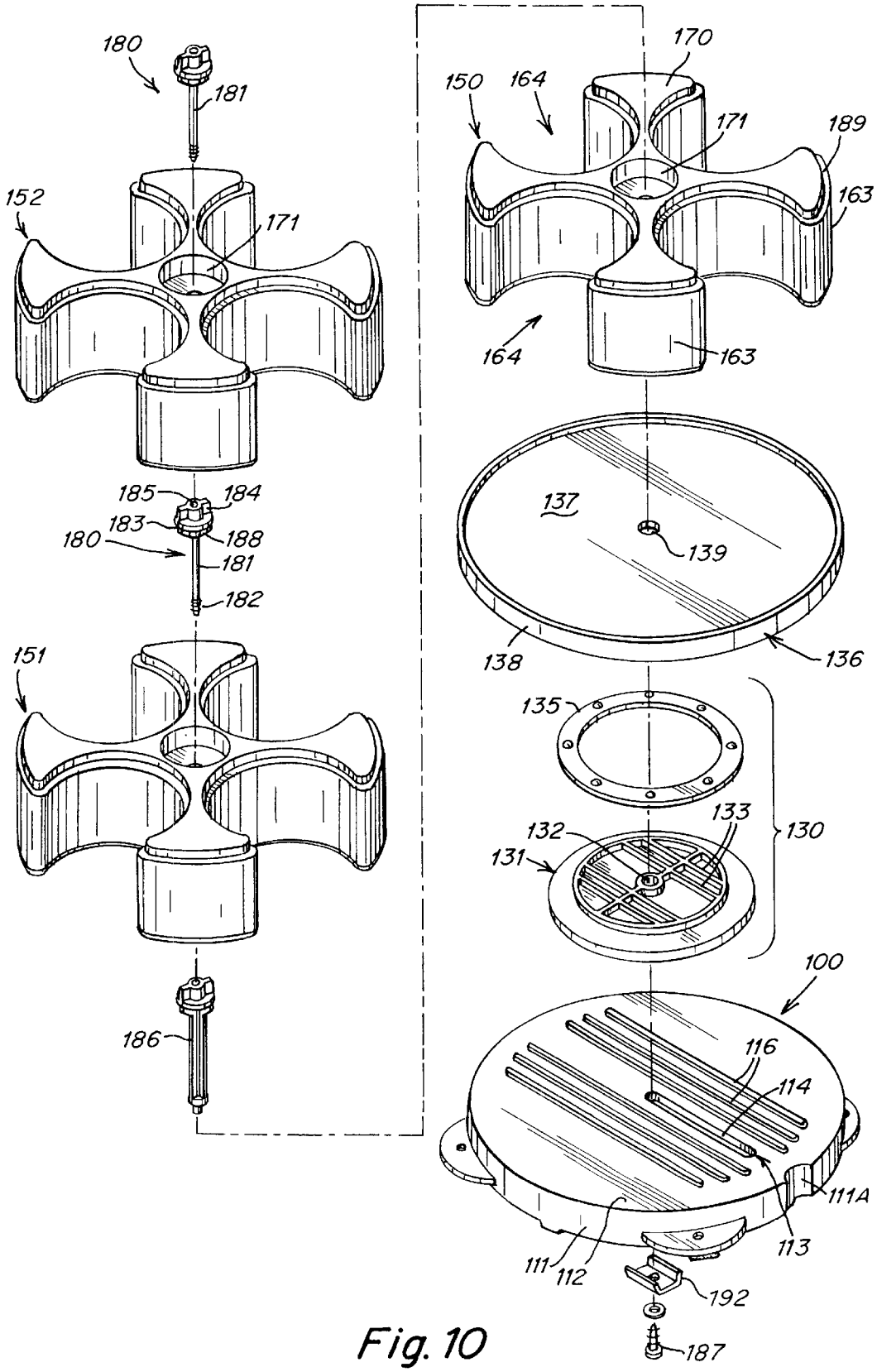
FIG. 10 is an exploded perspective view of the embodiment of FIG. 6.

FIGS. 6 through 10 inclusively illustrate a preferred embodiment of the present invention, which is also used primarily for storing containers, dishes, and similar articles. It may also be used to store other stackable or non-stackable articles commonly used in households, businesses, or in food storage activities. This unit consists primarily of a base 100, stackholder assembly 120, and means 130 for interengaging the base 100 and stackholder assembly 120 for movement of the stackholder assembly 120 to and from a position in vertical alignment with the base 100 (FIGS. 8 & 9). This system may be made of materials similar to the previously described embodiment. Preferably, however, the design of this system utilizes injection molded plastic. The base 100 is similar in overall shape to base 10, but may be varied in shape and size. Preferably it is cylindrical in shape, but may be varied, depending upon the shape and size of the space in which it is to be located. In a typical installation it may have an overall cylindrical diameter in the order of ten inches to two feet. The overall height and the number of stack units will depend upon the cabinet or counter shelf height in which the unit is positioned. In the embodiment illustrated in FIG. 6 the base 110 has a continuous sidewall 111 depending from a top 112. The sidewall or skirt 111 may be formed with an indent 111*a* to permit one to grasp assembly 120 and pull it out. The sidewall or skirt may have any desired height and may be provided with means for locking and securing the base to a shelf. Securing means may comprise a tab with screw holes extending from the base. Alternately, screws 195 may extend downwardly through the base into the supporting shelf or cabinet base. Other suitable means may also be used to secure the skirt 111. The top 112 is formed with an elongated slot 113 that extends radially from the center of the top to a distance short of the skirt 111 (FIG. 10). This slot 113 may be defined by a depending circumferential flange 114 (FIG. 9) that extends from its edge downwardly within the base 110. The base 110 may also be provided with a pair or more of parallel reinforcing ribs 115 that extends from the lower surface or undersurface of the top 112 transversely across the base 100. These ribs terminate short of flange 114 so as not to interfere with slot 113. The upper surface of the top 112 may be formed with a plurality of guide rails 116 to project upwardly from the surface of the top 112 in space relation to one another and parallel to slot 113.

The means of 130 for inter-engaging the base 110 and stackholder assembly 120 includes a bearing load base 131, which is coaxially mounted on the top 112 (FIGS. 9 & 10). The bearing load base 131 is formed with an opening 132 coaxially with and having the same diameter as the width of the slot 113 in the top 112 (FIG. 9). The bearing load base 131 is also formed with a plurality of upwardly extending ribs 133 and downwardly extending ribs 134. The downwardly extending ribs 134 that are spaced apart and parallel to one another, with the ribs 134 engaged and guided by the rails 116 formed in the top 112. A ball bearing race 135 of conventional design is positioned on the top surface of the bearing load base 131 at its outer periphery. Unlike the embodiment of FIGS. 1–5, the embodiment of this unit is provided with a base support 136 having a bottom 137 that sits on and covers the bearing load base 131 with the undersurface of the bottom 137 resting on and engaged by the ball bearing base 135. Sidewall 138 extends about periphery of the bottom 137, with the sidewall extending downwardly to form a skirt and slightly upwardly to form a retaining shoulder about the periphery of the bottom 137. An axial opening 139 is formed in the bottom 137 with the opening aligned with slot 113 and the opening 132. An annular flange 140 may extend downwardly from the undersurface of base support 136 with the flange 140 extending about the periphery of bearing load base 131.

Base support 136 forms a platform upon which a multiple number of individual stackable units are secured. In the embodiment illustrated three stackholders 150, 151, and 152 are illustrated. These are respectively aligned one on top of the other, while a preferred embodiment illustrated shows three stackholder units, fewer or greater numbers are also contemplated. The overall shape may also be varied from the cylindrical shape illustrated.

The stackholders 150, 151, and 152 are similar in construction. Each has an outer diameter slightly less than the outer diameter of the base support 136, each is coaxially aligned with it. Stackholders 150, 151, and 152 and are similar in structure and arranged in a nested relation one above the other. These stackholders are formed with an outer wall 163. The wall 163 has an irregular shape, which essentially defines a plurality of cylindrical wells 164 (FIG. 10). In the embodiment illustrated, four cylindrical wells 164 are defined. However, fewer or more are also contemplated. In the embodiment illustrated, the wells are all of substantially equal dimension and are arranged radially around the axis of the stackholders 150, 151, and 152 at 90 degrees from one another. However, the wells may be formed of different sizes and at different angles. Wells may also be specifically shaped to fit the contour of the components, which are to be stored within them. These wells are intended to receive like articles, such as dishes, manufacturing components and the like. The specific shape and size of the well may, therefore, be varied for the particular purpose for which the unit is intended. The wall 163 defining the wells and the outer surfaces of each of the stackholders 150, 151, and 152 its outer edge is defined by uniform radius from the center of the stackholders. In this preferred embodiment the wells themselves are defined by a portion of the wall 163 having an arcuate configuration. The arcuate surface is defined by a radius, which is less than half the distance between the center from which an adjacent radius of the well may be measured, thereby providing spacing between the adjacent wells. These dimensions are best illustrated in FIG. 7 by the dotted line defining the radius at 165. These centers 165 are close enough to the sidewall 138 to form relatively wide openings 166 with these openings having a width less than the diameter of the wells 164 so as to provide easy access to stacks of items positioned in each well, while at the same time providing sufficient wall surface to secure the stack of items within the well. Each of the stackholders 150, 151, and 152 is formed with a top wall 170 that extends entirely across the units with the top wall 170 in the preferred embodiment having essentially a cross like configuration. The top wall 170 is formed with a depression or well 171 extending radially outward from its center. The well 171 may be integrally formed with the stackholders 150, 151, and 152 or may be formed as a separate component secured to it. The production method depends largely upon molding processes and costs. This well 171 is formed with a bottom wall 172 and a connecting sidewall 173 extending upwardly from the bottom 172 to the top wall 170 (FIG. 8). The bottom 172 is formed with a central opening that is coaxial with the openings 139, 132 and the slot 113. These wells 171, in part form a means for interconnecting the stackholders one with the other. The interconnection between the stackholders 152 and 151, as well as any additional stackholders that might be used is effected by a connector generally illustrated at 180. The connector 180 is also used to connect the lower most stackholder 150 to the base 100. These connectors 180 comprise an elongated steel rod 181 having a threaded end 182 and a cap 183 at the end of the rod opposite its threaded end. The cap 183 is preferably molded plastic that is permanently molded to the upper end of the rod 181. It is formed with upwardly extending flange 184 shaped to permit finger turning, using integrally formed wings that extend outwardly from a center core. The center of the cap 183 is formed with a threaded recess 185 shaped and sized to receive the threaded end 182 of the connector 180 positioned immediately above it. The lower most connector 180 is also provided with a cylindrical open ended molded plastic connector 186.

Molded plastic connector 186 is positioned in the openings 139 and extends downwardly through the slot 113 (FIG.

9). The lower end of this connector 186 is engaged by a self tapping screw and washer assembly 187 that secures the slide plate 192 below the flange 114 in sliding engagement with it. The molded plastic connector 186 receives the lower most connector 180, which extends at least partially down the opening in the plastic connector 186. The cap 183 of the connector sits and is rotationally engaged with the bottom 172 of the well 171. Suitable means such as external or sleeve 188 may be used to inter-engage the rod 181 with the bottom 172 in a manner that will permit the rod be threaded downwardly.

The rods 181 of the uppermost stackholders 150 and 151 secure the stackholders in which they are positioned to the stackholder below by threadingly engaging the rod 181 with the threaded recess 185 in the cap 183 immediately below it.

The stackholders 150, 151, and 152 are aligned with one another with the lower edge of one resting on and engaging the upper edge of the stackholder immediately below it in a manner to form elongated wells that extend upwardly through each of the stackholders. For this purpose the upper periphery edge of each stackholder may be formed with a shoulder 189 shape and sized to receive a snug fit to the lower periphery of the stackholder immediately above it.

In this arrangement the stackholders may be locked one to the other.

This unit may be stored as shown in FIG. 6 or may be extended similarly to the arrangement of FIG. 1 when in use. When the stackholders are extended they may be rotated for easy access to any one of the wells 164.

Figure 11:
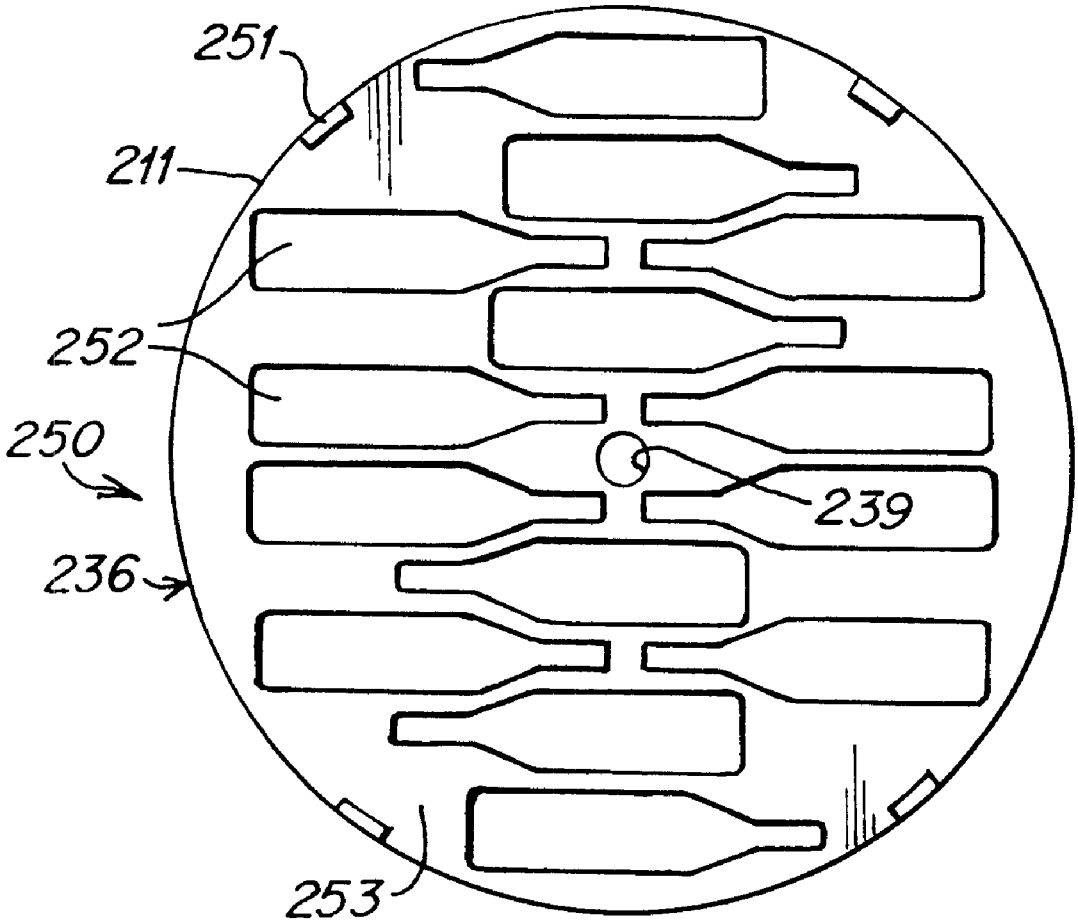
FIG. 11 is a plan view of a stackholder used in further embodiment of the invention.

The present invention also contemplates use for storage or containers such as bottles in which specially designed stackholders 250, such as shown in FIG. 11 are used. In this example, the stackholder 250 is designed to accommodate a series of bottles, such as wine bottles. The stackholder is formed with a base 236 having an outer periphery defined by an edge and a depending skirt 211 that is parallel to and aligned with a base that may be similar to the base 100 of the FIG. 6 embodiment. It is also formed with an axial opening 239 similar to the axial opening 139 for interengagement with connectors similar to connectors 180. Suitable means may be provided at spaced intervals about the edge 211 as illustrated at 251 to support a similar stackholder 250 above. The means 251 may comprise an upstanding sidewall segment with its upper end shaped to fit into a corresponding recess in a stackholder above.

The stackholder 250 is formed with a series bottle shaped recesses 252. These recesses or depressions in the surface 253 of stackholder 250 may have a depth of in the order of 30% to 40% of the diameter of an average 12" long bottle.

In place of the spacers 251 the arrangements contemplate each stackholder 250 has its depending skirt 211 extending downwardly at spaced intervals to space it from and support it on the next lower stackholder 250.

The system also contemplates a motorized system in which the unit is tuned by a motor control preferably located below the base.

What is claimed is:

1. A storage system for multiple stacks of like articles comprising:

a base, a stackholder assembly, and means for interengaging said base and stackholder assembly for movement of said stackholder assembly to and from a position in vertical alignment with said base; said stackholder assembly comprising separable upper and lower stackholder units having facing mating surfaces shaped to permit interengagement thereof, said upper and lower stackholder units having a plurality of aligned means for receiving a stack of like articles that may extend into both upper and lower stackholder units.

2. A storage system as set forth in claim 1 wherein said means for interengaging said base and said stackholder assembly comprises a slide having interengaged components moveable relative to one another with one interengaged component secured to the lower stackholder unit and another interengaged component secured to the base.

3. A storage system as set forth in claim 1 wherein said means for interengaging said base and said stackholder assembly comprises a pivot means with one portion of the pivot engaging the base and another part engaging the lower stackholder unit.

4. A storage system as set forth in claim 1 wherein said stackholder assembly comprises a cylindrical member having a plurality of article receiving compartments.

5. A storage system as set forth in claim 4 wherein said compartments are shaped and sized to receive different width stacks of articles.

6. A storage system for multiple stacks of containers and the like for storage in a cabinet, comprising a base and a stackholder assembly and means for interengaging the stackholder assembly for movement between a position in vertical alignment with the base within a cabinet and a position at least partially outside the cabinet; said stackholder assembly having a plurality of vertically extending compartments of different sizes shaped to receive different size stacks of articles.

7. A storage system for multiple stacks of containers as set forth in claim 6 wherein said stackholder assembly comprises a lower stackholder unit and upper removable modular stackholder units.

8. A dispenser for multiple stacks of containers and the like comprising: a plurality of stack of containers a base to be positioned in a storage area for said containers and the like, a support for said stacks, said support having means for receiving and holding said plurality of stacks, said stacks arranged in spaced columnar relation to one another, said support and base interengaged with one another by a slide mechanism in part engaging said base and in part to said support for movement of said support from and to a vertical alignment with said base.

9. A dispenser as set forth in claim 8 wherein said support has an overall cylindrical configuration and said means for receiving and holding a plurality of stacks comprises wells having sides and dimensions shaped to receive stacks of different sizes.

10. A dispenser for multiple stacks of similar elements comprising a base to be positioned in a storage area, a plurality of upwardly extending like units arranged in stacks, a support for said plurality of upwardly extending units arranged in stacks, said stacks of like units in parallel relation to one another, and means for supporting said support for rotation about an axis parallel to said stacks of like units and for displacing movement parallel to said axis.

11. A stackholder as set forth in claim 1 wherein each of said stackholder units are similar in shape, said stackholder units formed with a top wall and depending sidewalls, with the sidewalls having arcuate spaced segments at a uniform radial distance from a center with inwardly portions of the sidewall defining recesses in turn defining wells when a plurality of units are stacked one above the other.

12. A stackholder as set forth in claim 11 having a plurality of connectors for inter-engaging said units, said connectors extending vertically through the center of said units and having means for inter-engaging with one another.

13. A stackholder as set forth in claim 12 wherein said units are each formed with a centrally located well in which a portion of a connector is located and from which the connector extends downwardly for engagement.

14. A storage system as set forth in claim 6 wherein said vertically extending compartments are arranged parallel to one another.

15. A storage system comprising a base to be positioned in a storage area for containers and the like, a plurality of vertically aligned supports with each support shaped to receive stored articles, each of said supports for receiving in nested relation a plurality of horizontally aligned bottles thereon, a slide mechanism operatively interengaging said base and said vertically aligned supports for movement of said supports to and from vertical alignment with said base.

* * * * *